United States Patent [19]

Ahrweiler et al.

[11] 4,086,316

[45] Apr. 25, 1978

[54] PROCESS FOR THE MANUFACTURE OF FLAT SHEETS OR WEBS

[75] Inventors: Klaus Ahrweiler, Willich; Ferdinand Leifeld, Kempen; Kurt Quoos, Krefeld; Eduard Finkenweg 18 Küsters, 415 Krefeld-Forstwald, all of Germany

[73] Assignee: Eduard Kusters, Krefeld, Germany

[21] Appl. No.: 643,080

[22] Filed: Dec. 22, 1975

Related U.S. Application Data

[63] Continuation of Ser. No. 450,347, Mar. 12, 1974, abandoned.

[51] Int. Cl.[2] ..... B29J 1/02

[52] U.S. Cl. ..... 264/120; 264/128

[58] Field of Search ..... 264/120, 128; 162/206

[56] References Cited

U.S. PATENT DOCUMENTS

| | | | |
|---|---|---|---|
| 2,975,470 | 3/1961 | Snelson et al. | 264/128 |
| 3,044,111 | 7/1962 | Coughey | 264/120 |
| 3,230,287 | 1/1966 | Caron et al. | 264/120 |

*Primary Examiner*—Robert F. White
*Assistant Examiner*—James R. Hall
*Attorney, Agent, or Firm*—Kenyon & Kenyon, Reilly, Carr & Chapin

[57] ABSTRACT

A process for the manufacture of flat sheets or webs from a natural fiber material such as cellulose fibers in which the fibers to be processed are first placed on a substrate in the form of a dry heap after which an amount of water not exceeding the amount of moisture which can be absorbed by the fiber is added, whereupon the wetted fibers are subjected to pressure and temperature causing them to bond together forming a sheet or web. When sheets or webs of greater thickness are being made according to the present invention a further step of cooling before relieving pressure is carried out to avoid steam pockets formed within the web from breaking through upon release of pressure.

4 Claims, 1 Drawing Figure

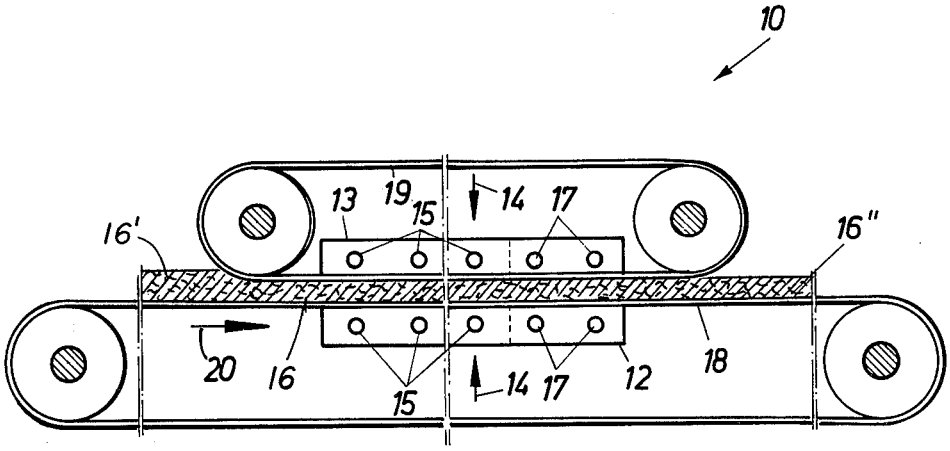
10
13
19
15
14
17
16'
16"
20
16
15
14
17
12
18

PROCESS FOR THE MANUFACTURE OF FLAT SHEETS OR WEBS

This is a continuation of application Ser. No. 450,347, filed Mar. 12, 1974, now abandoned.

BACKGROUND OF THE INVENTION

This invention relates to a process for the manufacture of flat sheets or webs of natural fiber material which have been comminuted (broken down) into individual fibers such as cellulose fibers, in general, and more particularly to an improved method of making such sheets and webs which uses only a minimal amount of water.

In the conventional paper making processes large amounts of water are used for the suspension of cellulose fibers. Of this large amount of water required, only approximately 1% of the water ends up in the finished paper product. As a result, large quantities of water must be used and handled during the process. In particular, this large quantity of water must be removed from the paper as it is processed. This is generally done at least in part by using mechanical means, i.e., using squeezing or suction to remove the water, or through thermal means such as drying cylinders. Whichever type of removal is employed, a large amount of expensive equipment is needed, which equipment also requires great amounts of energy for driving, thereby substantially increasing the cost of making the paper. In this prior method of making paper, the floating of the cellulose material in the water leads to the formation of sheets through a purely mechanical process in that the relative movement of the individual fibers with respect to one another and their sliding together to form a netted sheet-like structure is enhanced. The adherance between fibers in the finished sheet however, is not only due to the purely mechanical netting but is also a result of chemical bonding forces of various kinds, the action of which is promoted or even made possible by the aqueous phase. A chemical part of the bonding causes the netted fibers to be fixed in their arrangement with respect to one another and to form a sheet structure engendering these common bonding forces. It can thus be seen that this process requires at least a minimum amount of water.

Other methods of forming sheet structures which do not use water have been developed. In general, these have substituted separate bonding means for the mechanical and chemical bonding forces developed from the water and the fibers themselves in the above described method. In one method disclosed in British Pat. No. 897,295, a sheet with bonded fibers is shown in which a substrate surface is coated with a bonding material and with the aid of an electrostatic field the fibers are then transferred to this bonding layer, after which the resulting sheet is separated from the substrate or forming surface. A similar process is described in Danish Pat. No. 120,930, in which process the electrostatic field is used to orient the fibers perpendicularly before their transferal to the bonding layer with the fibers then being blown over into the binding layer through the use of air jets. A plurality of layers of different orientations are positioned one above the other. A further process is shown in British Pat. No. 1,239,642. In this process which is used for bonding the fibers of a cellulose web, the cellulose is brought into contact with dimethylsulfoxide containing 3 to 30% by weight of $NO_2$. This solution softens the cellulose fibers and results in a form of welding of the areas of contact of neighboring fibers without destroying the cohesiveness of the web. After a certain amount of time the solution is washed out and the web thereafter exhibits a substantially greater mechanical cohesiveness.

Although these various methods work quite well, it will be recognized that they require additional equipment, materials and so on. Thus, it can be seen that there is a need for an improved method which utilizes the inherent binding potential of the fibers themselves along with water without requiring the great amounts of water needed for the prior art process.

SUMMARY OF THE INVENTION

The present invention provides such a process in which the binding properties of small individual fibers of natural fiberous material such as cellulose when suspended in water are utilized in forming a flat sheet or web. This is accomplished without the need for a large amount of water. To accomplish this, a mass of substantially dry fibers is used as the starting material. The dry fibers are then moistened with an amount of water which is less than the amount of water which can be absorbed by the fibers. Thereafter the moistened mass is heated to a temperature above 100° C while being subjected to a flattening pressure forming the mass into a sheet. Pressure and temperature are applied to the flattened sheet continuously for a predetermined time of sufficient length to ensure good fiber bonding.

BRIEF DESCRIPTION OF THE DRAWING

The single FIGURE is a schematic illustration of a type of press apparatus which can be used in carrying out the method of the present invention.

DETAILED DESCRIPTION OF THE PREFERRED EMBODIMENT

Prior to describing in detail the manner of carrying out the method of the present invention, a typical press apparatus which can be used to obtain the necessary temperatures and pressures will be described. On the FIGURE, this apparatus is shown in a more or less schematic form. More details as to a specific type of apparatus which may be used are shown in Swiss Pat. No. 327,433. The apparatus illustrated on the FIGURE and designated generally as a press 10 includes two pressure generating means 12 and 13 which apply pressure in the direction of arrows 14 through two pressure belts 18 and 19 to a web 16 moving therebetween. The lower belt 18 and upper belt 19 are supported against the pressure generating means 12 and 13 through friction reducing means such as rollers not shown in detail on the FIGURE. In one zone of the pressing means 12 and 13 a plurality of heating means such as heating channels 15 are provided to which a heating medium can be admitted to raise the temperature in the zone therebetween to above 100° C. Also installed within the pressure zone between the two pressing means are cooling means such as cooling channels 17 through which a cooling medium can be passed. Material enters the press as a heap of fibers 16', is formed into a fiber layer or web 16 between the pressure belts 18 and 19 and exits the press as a sheet 16''.

In carrying out the process of the present invention, the fibers are first placed on a support during processing in some form of layer corresponding in general to the starting material layer in a standard paper machine with the exception that the fibers of the present invention are not suspended in a large amount of water but rather from a dry heap. In terms of the apparatus of the FIGURE, this dry heap 16' is formed at the left hand side of the lower belt 18. As noted above, at least a certain amount of water is required in order to produce bonding between the fibers. As will be described in more detail below, the water increases the pliancy of the fibers and is a necessary pre-requisite for causing chemical bonding. Thus, the next step is the addition of water to the dry fibers. In accordance with the present invention, the maximum amount of water used in moistening the fibers is an amount equal to the moisture absorptive capacity of the fibers. By moisture absorptive capacity is meant the amount of liquid per weight of fiber that the fiber can absorb at a given temperature and which cannot subsequently be removed by mechanical means such as squeezing or suction. What is involved is that the water permeates the cell structures of the fibers remaining therein as distinguished from water within the web remaining on the surface of the fibers. The moisture absorptive capacity of the fibers decreases sharply with increasing temperatures.

A particularly advantageous method of moistening the fibers with the relatively small amount of water required is by subjecting the mass of dry fibers at normal temperature to steam which condenses thereupon in an easily controllable amount. For a short period after introduction of the water to the dry fibers, the water remains on the surface of the fibers in the form of a film or small drops. The next step in accordance with the method of the present invention is subjecting the fibers to a temperature of over 100° C while being subjected to a sheet-forming pressure. At this higher temperature, the permeation of the water into the fibers and the pliancy of the fibers is enhanced. Moreover, the increased temperature results in the formation of bonds such as are present in the form of hydrogen linkages between the cellulose fibers in the completed paper. Both of these results which are attributable to an increase in the speed of diffusion caused by the increase in temperature, result from its effects first on the diffusion of water into the fiber and further from the diffusion within the water itself.

As noted above, the amount of water added should be below the moisture absorptive capacity of the fibers in their normal temperature condition. As the temperature increases, the moisture absorptive capacity of the fibers decreases sharply so that the amount of water which has been added is greater than the moisture absorptive capacity of the fibers. Thus, at this increased temperature, only a portion of the added water is absorbed into the fibers. As also noted above, this absorption increases their pliancy. The remainder of the water outside the fiber causes both the formation of chemical bonding and also results in evaporation or steam formation causing equal distribution of the water assuring that water absorption will occur uniformerly in the mass of the fibers. Furthermore, according to the present invention, along with the increasing of the temperature, pressure is applied. In the illustrated embodiment, the application of this high temperature and pressure is accomplished by causing the fiber heap 16' on the belt 18 to pass into the pressure zone between the belts 18 and 19 in the direction of arrow 20. The pressure is applied as described above by the pressing means 12 and 13 through the belts 18 and 19 with heat supplied by the heating medium which is provided to the channels 15 in the pressing means 12 and 13.

The application of the pressure causes a mechanical compression of the fibers which have been made pliable by the water thereby increasing the surface contact between the fibers and improving the conditions for adhesion. Adhesion results from Van der Waal's forces between the molecules of the cellulose fibers and has its maximum at a particular proximity between the fibers which is herein achieved through the application of pressure. The contact points of the fibers, which are held together by the applied pressure and are ready for bonding, have water available both internally in the fibers and externally in the form of steam or surface water thereby permitting the water to exercise its bonding effect at the points of contact. Through these means a maximum amount of bonding is achieved with a minimum amount of water.

In order to achieve good bonding it is necessary that the pressure be maintained for a predetermined time. This is required since the water applied to the fibers permeates the fibers by diffusion, which process of diffision is dependent on time. Furthermore, the heating which is necessary for the evaporation of water not within the fibers and for the formation of a uniform steam atmosphere in the pressed together fiber layer takes place by means of conduction from the channels 15 through the pressing means and belts to the fiber layer. This process is also dependent on time since only a given amount of heat can be transmitted into the fiber layer during a given amount of time. As a result, the sheet formation of the present invention does not occur as an instantaneous reaction but takes place over a predetermined period of time, during which time pressure and temperature must be maintained.

The required duration of pressure and temperature exertion is longer than that which would occur if the web was passed through the pressure zones of one or a plurality of pairs of pressed rollers. Furthermore, the use of pressed rollers would result in a relief of pressure between the individual pairs of rollers and would not maintain the necessary condition of constant pressure needed to achieve good bonding according to the present invention. As a consequence, an attempt to use the process of the present invention with such rollers would result in improper bonding. Such pressure and temperature application for the required period of time is attained in the apparatus of the present invention by having the fiber heap 16' pass through the pressure zone between the two pressing means 12 and 13, which cover a considerable area. Here it is formed into a fiber layer or web 16. Thus, any increment of the web 16 is subjected to temperature and pressure for at least the time it takes to travel from the beginning of the pressing means to the end of the zones containing the heating channels 15. In general terms, the time during which the temperature and pressure must be applied is the time necessary for the evaporation of the applied water needed for good fiber bonding. Experiments have shown that satisfactory sheet formation occurs if the sheet forming pressure is maintained for a period longer than one second. Based on this it is then only necessary to insure that the velocity of the fiber layer moving through the press apparatus within the heated pressure zone is such that it is heated under pressure for at least one second. In addition, experiments have shown that the best results are achieved if the sheet forming pressure is in the range of 10 to 50 kg per $cm^2$.

In order to avoid complications resulting from trapped air in the fiberous mass during the application of the sheet forming pressure it is advantageous to subject the mass to a predensification subsequent to the application of water but prior to the application of the sheet forming pressure. As noted above, the sheet forming pressure is applied in the present invention between pressure surfaces maintained at a temperature of over 100° C. In the apparatus shown on the FIGURE, a certain amount of predensification will occur in the area between the belts 18 and 19 prior to entering the pressure zone defined by the pressure applying means 12 and 13. It should be noted that although this particular embodiment of apparatus is disclosed that other types of apparatus may be used. This depends at least to some degree on the nature of the shape or web being produced. For example, if sheets which are individual sheets are to be produced, a conventional stamp press with appropriate pressure surfaces can be used. In most cases however, it is preferable that the sheets or webs be produced in a continuous manner in the form of traveling webs. For this purpose, the apparatus disclosed on the FIGURE is preferable.

The steam generated by the application of heat during the pressure in the heated zone is normally trapped between the pressure surfaces. If pressure is removed, i.e., either by lifting a conventional press or when the web leaves a heated pressure application zone, the steam escapes. If thin paper sheets are being manufactured, this is of no consequence since, by virtue of the small volume, only a small amount of steam is present which must travel only a short way within the fiber layer. However, an important application of the present invention is in the formation of thicker sheets of paper board or cardboard which in some cases can be several milimeters thick. In these sheets certain amounts of steam can accumulate and, because of the increased thickness, the web will provide additional resistance to the escape of steam. As a result, upon the removal of pressure, the rapidly expanding and escaping steam can split the sheet. To avoid problems of this nature, the cooling section of the press apparatus shown on the FIGURE is provided. Thus, after having passed through the heated pressure zone within the area of the heating channels 15, the web 16 then passes through a further pressure zone which is cooled by cooling medium flowing from the channels 17 so that upon exiting from the pressure zone as sheet 16 it is cooled down. During the cooling, the steam condenses and is absorbed by the fibers. Since initially the amount of water added is only that amount of water that can be absorbed by the fibers at normal temperature, and it was from this water that the steam was formed, all water present is capable of being absorbed by the fibers and a web free of surface moisture will result. Thus, after cooling, there will be no steam pressure in the web thereby avoiding any ripping or spliting upon removal of the pressure and all of the condensed water will have been or will shortly be absorbed into the fibers resulting in a web free of any surface moisture. The pressure applied to the web in the cooling zone in the area of the cooling ducts 17 can be less than the pressure applied during the sheet forming. It is only necessary that there be no sudden release of the steam within the web. When using other types of press apparatus, similar measures may be taken when forming heavy sheets to insure that cooling of the sheet or web takes place before removal of the pressure.

Thus, an improved method of making sheets or webs from natural fibers such as cellulose and which utilizes the inherent bonding properties of the fibers with water has been described. Although specific steps and apparatus for carrying out those steps has been shown and described, it will be obvious to those skilled in the art that various modifications may be made without departing from the spirit of the invention which is intended to be limited solely by the appended claims.

What is claimed is:

1. A process for manufacturing, from natural fibrous cellulose material which has been comminuted into individual fibers, a flat sheet selected from the group consisting of paper and cardboard, comprising:

(a) placing a substantially dry mass of this comminuted cellulose material upon a support;

(b) moistening said mass with an amount of water less than the moisture absorptive capacity of said mass;

(c) hot pressing said mass at a temperature above 100° C and at a pressure of 10–50 kg/cm/sq for a period of at least 1 second to form said mass into a flat sheet and cause said individual fibers to hydrogen bond;

(d) cooling said formed sheet while maintaining pressure thereon equal to or less than that in step (c), but sufficient to prevent the sudden release of steam formed in said mass during step (c), whereby said cooling condenses formed steam to release said formed sheet of steam pressure and thereby avoid ripping or splitting of said sheet upon subsequent release of said pressure;

(e) relieving said pressure from said flat fiber bonded cellulose sheet, and (f) removing said bonded cellulose sheet from said support.

2. The process of claim 1 wherein step (b) comprises;

(a) directing steam into said fiber mass while said mass is at a temperature resulting in condensation of said steam.

3. The process of claim 1 wherein step (c) is carried out between pressing surfaces maintained at a temperature above 100° C.

4. The process of claim 1 wherein between steps (b) and (c), said mass is precompressed to relieve said mass of trapped air and complications resulting therefrom during step (c).

* * * * *